US009046861B2

(12) United States Patent
Ohno et al.

(10) Patent No.: US 9,046,861 B2
(45) Date of Patent: Jun. 2, 2015

(54) IMAGE-FORMING APPARATUS

(71) Applicant: CANON KABUSHIKI KAISHA, Tokyo (JP)

(72) Inventors: Masaru Ohno, Ebina (JP); Shinji Katagiri, Yokohama (JP); Shuichi Tetsuno, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/310,480

(22) Filed: Jun. 20, 2014

(65) Prior Publication Data

US 2015/0003880 A1 Jan. 1, 2015

(30) Foreign Application Priority Data

Jun. 26, 2013 (JP) ..... 2013-133979

(51) Int. Cl.
*G03G 15/00* (2006.01)

(52) U.S. Cl.
CPC ..... *G03G 15/80* (2013.01)

(58) Field of Classification Search
None
See application file for complete search history.

(56) References Cited

U.S. PATENT DOCUMENTS

| | | | | |
|---|---|---|---|---|
| 6,021,287 | A * | 2/2000 | Tanaka | 399/66 |
| 2013/0188980 | A1 | 7/2013 | Ito et al. | |
| 2013/0195519 | A1 | 8/2013 | Ito et al. | |

FOREIGN PATENT DOCUMENTS

| | | |
|---|---|---|
| JP | 2012-098709 A | 5/2012 |
| JP | 2012-128363 A | 7/2012 |
| JP | 2012-137733 A | 7/2012 |

* cited by examiner

*Primary Examiner* — Clayton E Laballe
*Assistant Examiner* — Jas Sanghera
(74) *Attorney, Agent, or Firm* — Fitzpatrick, Cella, Harper & Scinto

(57) ABSTRACT

An image-forming apparatus includes: a plurality of image bearing members for carrying toner images; an intermediate transfer member that is capable of rotating endlessly and possesses conductivity; a current supply member that contacts an outer peripheral surface of the intermediate transfer member; a power supply that applies a voltage to the current supply member; a contact member disposed in a position corresponding to at least one of the image bearing members via the intermediate transfer member so as to contact an inner peripheral surface of the intermediate transfer member; an opposing member that opposes the current supply member via the intermediate transfer member; a constant voltage element connected to the opposing member and the contact member; and a resistance element electrically connected between the constant voltage element and the contact member.

14 Claims, 10 Drawing Sheets

IMAGE-FORMING APPARATUS

BACKGROUND OF THE INVENTION

1. Field of the Invention

The present invention relates to an image-forming apparatus.

2. Description of the Related Art

A conventional image-forming apparatus such as a copier or a laser beam printer uses an intermediate transfer member (referred to hereafter as an intermediate transfer belt). During a primary transfer process performed in this type of image-forming apparatus, a toner image formed on a surface of a drum-shaped electrophotographic photoreceptor (referred to hereafter as a photosensitive drum) is transferred onto the intermediate transfer belt by supplying a voltage from a high voltage power supply to a primary transfer member disposed in a position opposing the photosensitive drum. By executing this primary transfer process repeatedly in relation to toner images in a plurality of colors, toner images in a plurality of colors are formed on the surface of the intermediate transfer belt. Next, as a secondary transfer process, a voltage is supplied from the high voltage power supply to a secondary transfer member such that the toner images in the plurality of colors formed on the intermediate transfer belt are transferred together onto a surface of a recording material such as a sheet of paper. The toner images transferred together onto the recording material are then permanently fixed by fixing means, whereby a color image is formed.

Japanese Patent Application Publication No. 2012-98709 discloses a configuration in which primary transfer of a toner image onto an intermediate transfer belt is performed by applying a voltage to a current supply member that contacts the intermediate transfer belt such that a current flows from the current supply member to a plurality of photosensitive drums via the intermediate transfer belt. With this configuration, primary transfer can be performed without a high voltage power supply used exclusively for primary transfer, and as a result, reductions in the cost and size of the image-forming apparatus can be achieved.

Further, with the configuration disclosed in Japanese Patent Application Publication No. 2012-98709, a surface potential (referred to hereafter as a belt potential) of the intermediate transfer belt is kept constant by connecting a constant voltage element to respective support rollers, and in so doing, a primary transfer performance can be stabilized. An example in which a Zener diode is used as the constant voltage element is disclosed. By connecting a Zener diode to the respective support rollers in this manner, the belt potential is prevented from increasing to or above a potential generated in the Zener diode, and as a result, the belt potential of the intermediate transfer belt, which contacts the respective support rollers, can be kept constant.

However, with the configuration disclosed in Japanese Patent Application Publication No. 2012-98709, according to which primary transfer is performed from the plurality of photosensitive drums by causing a current to flow in a circumferential direction of the intermediate transfer belt, it is difficult to maintain the belt potential at an appropriate value in both an image-forming station near the current supply member and an image-forming station far from the current supply member. When the belt potential cannot be maintained, a required toner amount cannot be transferred onto the intermediate transfer belt, and as a result, problems such as density reduction occur.

More specifically, in a configuration where primary transfer is performed by causing a current to flow in the circumferential direction of the intermediate transfer belt, a voltage drop occurs in the belt potential in each image-forming station due to resistance in the circumferential direction of the intermediate transfer belt. As a result, the belt potential decreases steadily toward the image-forming stations further from the current supply member, possibly leading to a large potential difference between image-forming stations on an upstream side and a downstream side of a movement direction of the intermediate transfer belt. In this case, an appropriate belt potential for primary transfer cannot be formed in the respective image-forming stations, and therefore primary transfer cannot be achieved favorably.

SUMMARY OF THE INVENTION

In consideration of the problems described above, an object of the present invention is to secure a favorable primary transfer performance by suppressing supply of an excessive current to a plurality of image bearing members.

To achieve the object described above, an image-forming apparatus according to the present invention includes the following.

An image-forming apparatus comprising:

- a plurality of image bearing members for carrying toner images;
- an intermediate transfer member that is capable of rotating endlessly and possesses conductivity;
- a current supply member that contacts an outer peripheral surface of the intermediate transfer member;
- a power supply that applies a voltage to the current supply member;
- a contact member that is disposed in a position corresponding to at least one of the image bearing members via the intermediate transfer member and contacts an inner peripheral surface of the intermediate transfer member;
- an opposing member that opposes the current supply member via the intermediate transfer member;
- a constant voltage element connected to the opposing member and the contact member; and
- a resistance element electrically connected between the constant voltage element and the contact member.

Further features of the present invention will become apparent from the following description of exemplary embodiments (with reference to the attached drawings).

DESCRIPTION OF THE EMBODIMENTS

Exemplary embodiments of the present invention will be described in detail below with reference to the drawings. Note, however, that dimensions, materials, shapes, relative positions, and so on of constituent components described in the embodiments are to be modified appropriately in accordance with a configuration of an apparatus to which the invention is applied and various conditions, and unless specific description is provided to the contrary, are not intended to limit the scope of the present invention.

First Embodiment

Description of Image-Forming Apparatus

Figure 1:
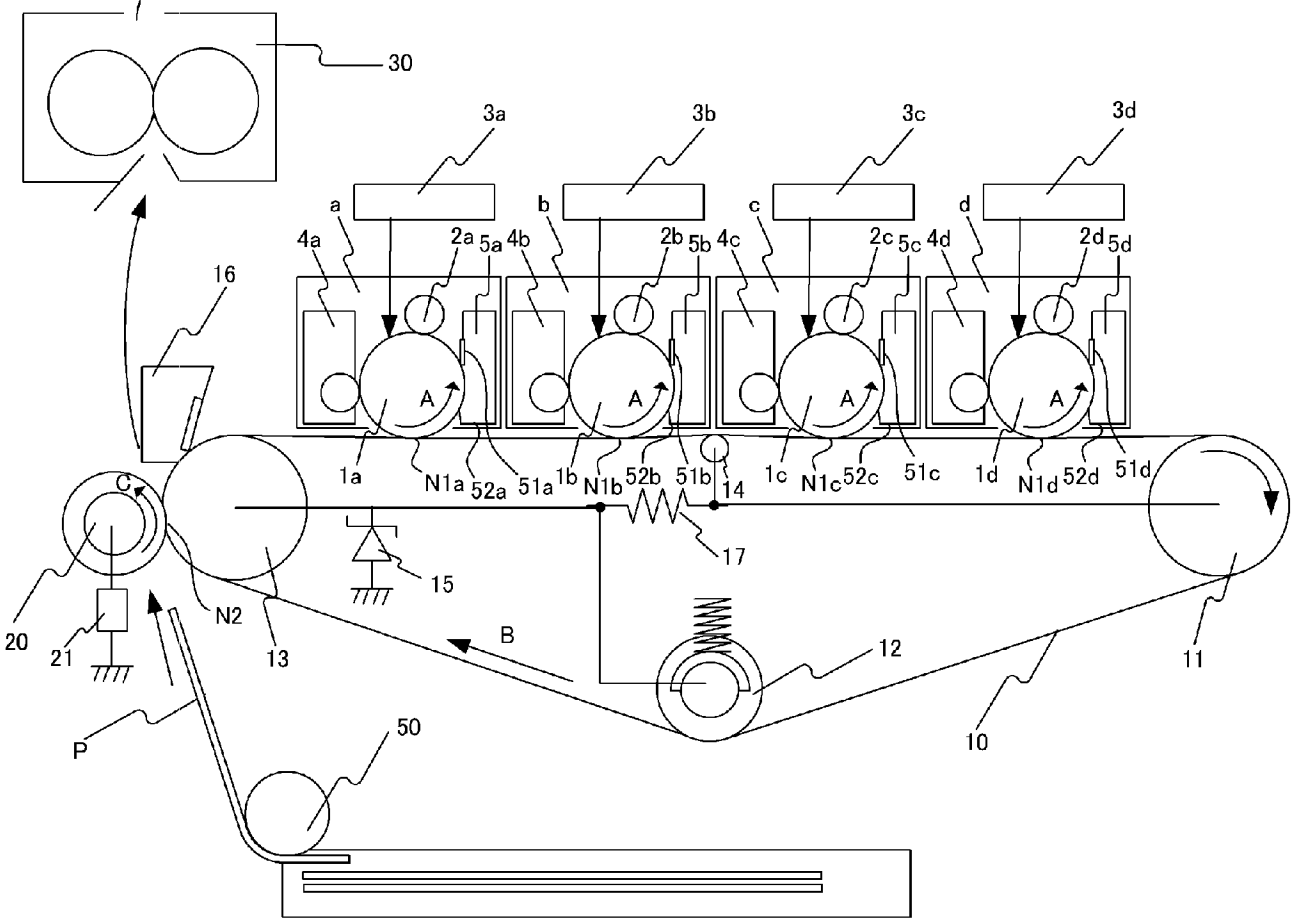
FIG. 1 is a schematic sectional view showing a configuration of an image-forming apparatus according to a first embodiment.

First, using FIG. 1, a configuration and an operation of a color image-forming apparatus (referred to simply as an image-forming apparatus hereafter) according to a first embodiment will be described. FIG. 1 is a schematic sectional view showing the configuration of the image-forming apparatus according to the first embodiment. The image-forming apparatus according to the first embodiment is a so-called tandem type printer including a plurality of image-forming stations. A first image-forming station a, a second image-forming station b, a third image-forming station c, and a fourth image-forming station d form images in yellow (Y), magenta (M), cyan (C), and black (Bk), respectively. Apart from the color of toner housed therein, the respective image-forming stations are configured identically, and will therefore be described below using the first image-forming station a, while description of the other image-forming stations will be omitted.

The first image-forming station a includes an electrophotographic photoreceptor (referred to hereafter as a photosensitive drum) 1*a* serving as a drum-shaped image bearing member, a charging roller 2*a* serving as charging means, a developing device 4*a* serving as developing means, and a cleaning device 5*a*. The photosensitive drum 1*a* is provided to be driven to rotate at a predetermined peripheral velocity (process speed) in a direction of an arrow A in FIG. 1.

The developing device 4*a*, which houses yellow (Y) toner (developer), is a device that develops yellow toner on the photosensitive drum 1*a*. The cleaning device 5*a* includes a cleaning blade 51*a* serving as a cleaning member that contacts the photosensitive drum 1*a*, and a toner box 52*a* housing toner collected by the cleaning blade 51*a*.

When a control unit (not shown) such as a controller receives an image signal, an image-forming operation starts, and accordingly, the photosensitive drum 1*a* is driven to rotate. The photosensitive drum 1*a*, while rotating, is uniformly charged to a predetermined potential at a predetermined polarity (negative polarity in the first embodiment) by the charging roller 2*a*, and then exposed to light in accordance with the image signal by exposing means 3*a*. As a result, an electrostatic latent image corresponding to a yellow color component image of a target color image is formed on the photosensitive drum 1*a*.

Next, the electrostatic latent image is developed by the developing device (yellow developing device) 4*a* in a developing position so as to be made visible as a yellow toner image (a developer image). Here, in the first embodiment, a normal charging polarity of the toner housed in the developing device 4*a* is negative polarity.

An intermediate transfer belt 10 is stretched across (supported by) a plurality of stretching rollers 11, 12, 13 serving as stretching members. The intermediate transfer belt 10 is oriented (in a direction of an arrow B in FIG. 1) to move in an identical direction to the photosensitive drum 1*a* in a contact portion with the photosensitive drum 1*a* (referred to hereafter as a primary transfer portion) N1*a*, and supported to be capable of moving (capable of rotating) at a substantially identical peripheral velocity to the photosensitive drum 1*a*. The yellow toner image formed on the photosensitive drum 1*a* is transferred onto the intermediate transfer belt 10 while passing through the primary transfer portion N1*a* (primary transfer).

During primary transfer according to the first embodiment, a current is caused to flow in a circumferential direction of the intermediate transfer belt 10 from a secondary transfer roller 20 serving as a secondary transfer member (a current supply member) that contacts an outer peripheral surface of the intermediate transfer belt 10. As a result, a primary transfer potential is formed on respective primary transfer portions N1*a* to N1*d* of the intermediate transfer belt 10.

Following primary transfer, primary untransferred toner remaining on a surface of the photosensitive drum 1*a* is cleaned and removed by the cleaning device 5*a* and then used in an image-forming process following charging. A second color magenta toner image, a third color cyan toner image, and a fourth color black toner image are then formed similarly by the second, third, and fourth image-forming stations b, c, d. The toner images are transferred successively onto the intermediate transfer belt 10 so as to overlap, whereby a synthesized color image corresponding to the target color image is obtained.

The four color toner images subjected to primary transfer onto the intermediate transfer belt 10 are transferred together (secondary transfer) onto a surface of a recording material P serving as a transfer material fed from paper feeding means 50 while passing through a secondary transfer portion N2 in which the intermediate transfer belt 10 and a secondary transfer roller 20 are formed. The secondary transfer roller 20 used here has an outer diameter of 18 mm, and is formed by covering a nickel-plated steel rod having an outer diameter of 8 mm with a foamed sponge body that has nitrile-butadiene rubber (NBR) and epichlorohydrin rubber as main components and has been adjusted to a volume resistivity of $10^8$ Ω·cm and a thickness of 5 mm.

The secondary transfer roller 20 contacts the outer peripheral surface of the intermediate transfer belt 10 at an applied pressure of 50 N, thereby forming the secondary transfer portion N2. The secondary transfer roller 20 is provided to rotate in a direction of an arrow C in FIG. 1, or in other words so as to follow rotation of the intermediate transfer belt 10. Further, during secondary transfer for transferring the toner on the intermediate transfer belt 10 onto the recording material P, such as a sheet of paper, a voltage of 2500 [V] is applied to the secondary transfer roller 20 from a secondary transfer power supply (a power supply) 21.

Figure 10:
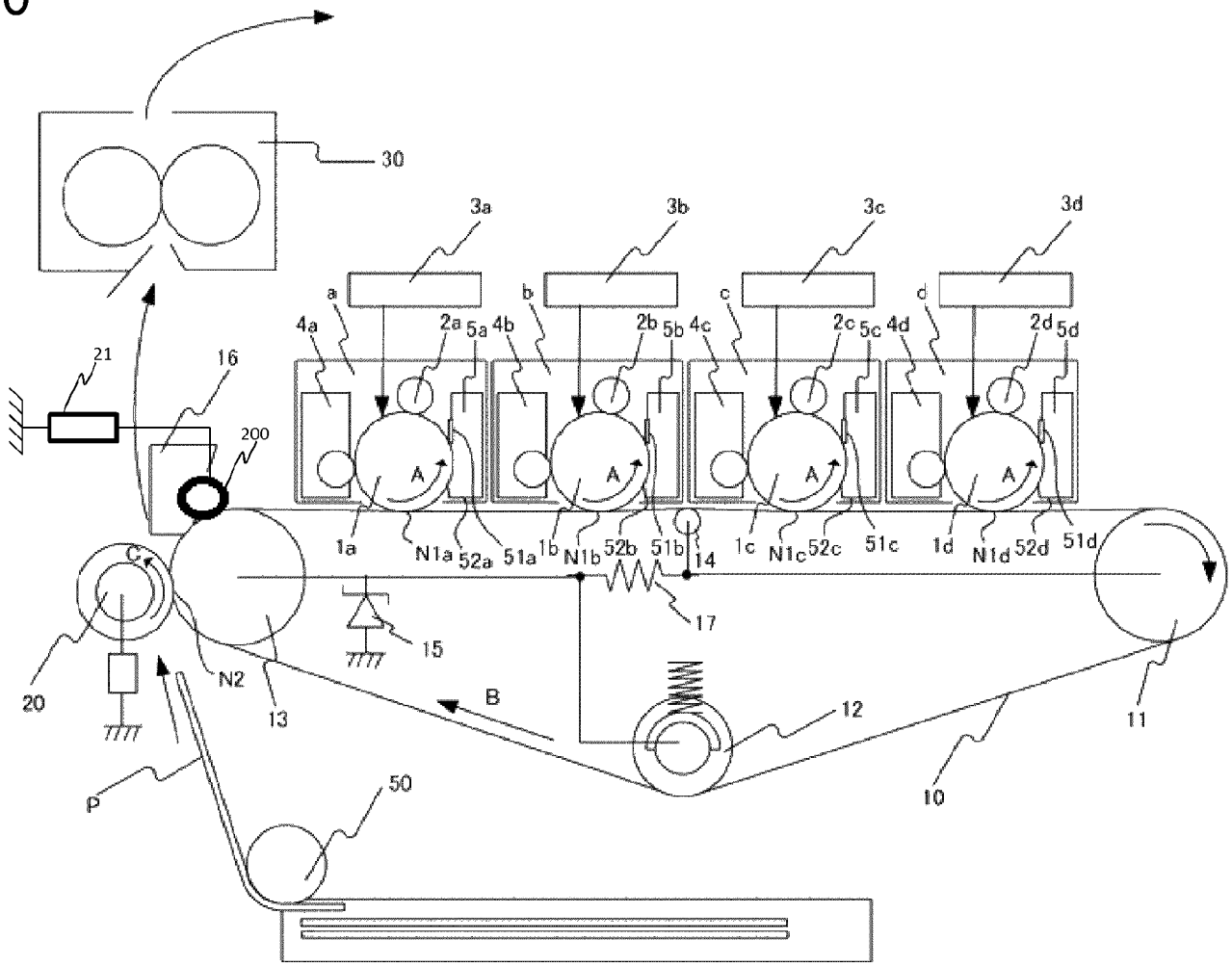
FIG. 10 is a schematic sectional view showing a configuration of another image-forming apparatus according to the first embodiment.

Next, the recording material P carrying a four-color toner image is introduced into a fixing unit 30, where the toner in the four colors is melted and mixed, and thereby fixed onto the recording material P, by applying heat and pressure thereto. Toner remaining on the intermediate transfer belt 10 following secondary transfer is cleaned and removed by a cleaning device 16 provided in contact with the intermediate transfer belt 10. As a result of the operation described above, a full color printed image is formed. Note that the current supply member is not limited to the secondary transfer roller 20. As shown in FIG. 10, for example, a collecting member 200 that rotates so as to follow the rotation of the intermediate transfer belt 10 in order to collect the toner remaining on the intermediate transfer belt 10 may be employed, and a voltage may be applied to the collecting member 200. A current may then by caused to flow in the circumferential direction of the intermediate transfer belt 10 from the collecting member 200 to which the voltage is applied.

[Configuration for Performing Primary Transfer]

Figure 2A:
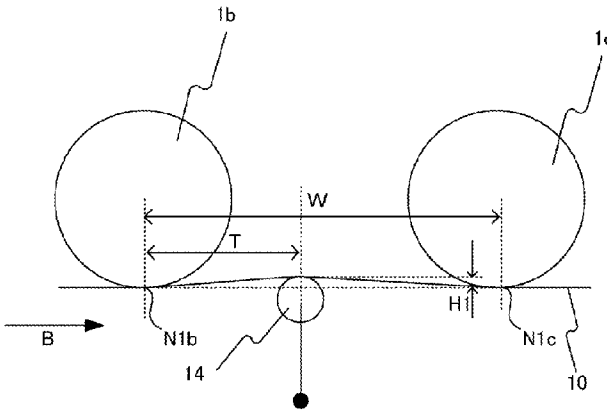
FIGS. 2A and 2B are views illustrating a configuration for supporting an intermediate transfer belt in a stretched condition.
Figure 2B:
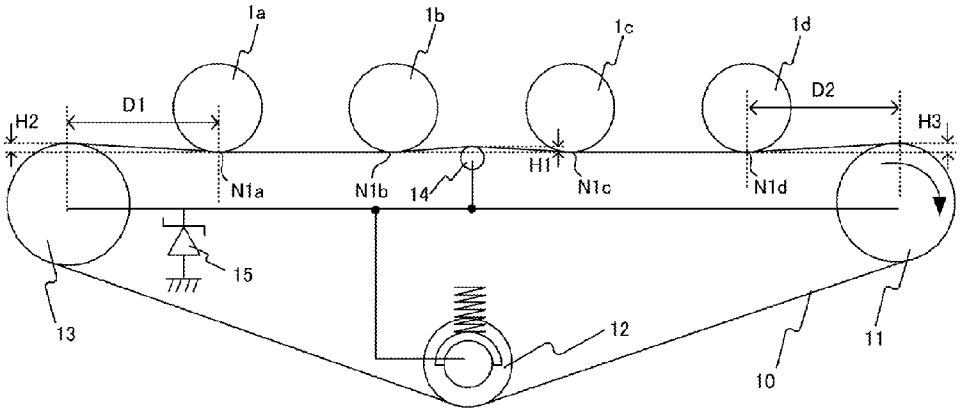

Next, a configuration for performing primary transfer will be described. First, referring to FIGS. 1 and 2, the intermediate transfer belt 10, the stretching rollers 11, 12, 13, a metal roller 14 serving as a contact member, and a voltage maintaining element 15, which together serve as a configuration required to form the primary transfer potential on the respective primary transfer portions N1*a* to N1*d*, will be described. FIG. 2 is a view illustrating a configuration for supporting the intermediate transfer belt in a stretched condition. FIG. 2A is a view showing a position of the metal roller, and FIG. 2B is a view showing the intermediate transfer belt supported in a stretched condition.

The intermediate transfer belt 10 serving as an intermediate transfer member is disposed in a position opposing the respective image-forming stations a, b, c, d (the respective photosensitive drums 1*a*, 1*b*, 1*c*, 1*d*). The intermediate transfer belt 10 is an endless belt which is made conductive by adding a conducting agent to a resin material. The intermediate transfer belt 10 is stretched across (supported by) three shafts serving as stretching members, namely a driver roller 11, a tension roller 12, and a secondary transfer opposing roller (an opposing member) 13, and stretched by the tension roller 12 at a tension having a total pressure of 60 N.

The intermediate transfer belt 10 is oriented to move in an identical direction to the primary transfer portions N1 respectively contacting the photosensitive drums 1*a*, 1*b*, 1*c*, 1*d*, and driven to rotate at a substantially identical peripheral velocity to the photosensitive drums 1*a*, 1*b*, 1*c*, 1*d* by the driver roller 11, which is rotated by a drive source (not shown).

As shown in FIG. 2A, the metal roller 14 serving as a contact member is disposed in the vicinity of the primary transfer portions N1*b*, N1*c* of the photosensitive drum 1*b* and the photosensitive drum 1*c* (in the vicinity of the primary transfer portion). More specifically, the metal roller 14 is disposed in contact with an inner peripheral surface of the intermediate transfer belt 10 in a position between the photosensitive drum 1*b* and the photosensitive drum 1*c* in the movement direction of the intermediate transfer belt 10. In other words, the metal roller 14 is disposed in an intermediate position between the second image-forming station b and the third image-forming station c. Respective end portions of the metal roller 14 are held (supported) in a raised position relative to a horizontal plane formed by the photosensitive drums 1*b*, 1*c* and the intermediate transfer belt 10 so that a winding amount of the intermediate transfer belt 10 against the photosensitive drums 1*b*, 1*c* can be secured.

The metal roller 14 is constituted by a round rod made of nickel-plated SUS (stainless steel) and having a straight shape and an outer diameter of 6 mm, and rotates so as to follow the rotation of the intermediate transfer belt 10.

As shown in FIG. 2A, a distance between the photosensitive drum 1*b* and the photosensitive drum 1*c* is defined as W, a distance from the photosensitive drums 1*b*, 1*c* to the metal roller 14 is defined as T, and a raised height of the metal roller 14 relative to the intermediate transfer belt 10 is defined as H1. The distance W and the distance T are distances between adjacent axial centers in the movement direction of the intermediate transfer belt 10. In the first embodiment, W=60 mm, T=30 mm, and H1=2 mm.

Further, in the first embodiment, as shown in FIG. 2B, the driver roller 11 and the secondary transfer opposing roller 13 are raised relative to a horizontal plane formed by the photosensitive drums 1*a* to 1*d* and the intermediate transfer belt 10 in order to secure a winding amount of the intermediate transfer belt 10 relative to the photosensitive drums 1*a*, 1*d*. By securing the winding amount of the intermediate transfer belt 10 relative to the photosensitive drums 1*a*, 1*d*, transfer defects occurring when contact between the photosensitive drums 1*a*, 1*d* and the intermediate transfer belt 10 becomes unstable are suppressed.

Furthermore, as shown in FIG. 2B, a distance between the secondary transfer opposing roller 13 and the photosensitive drum 1*a* is set as D1, and a distance between the driver roller 11 and the photosensitive drum 1*d* is set as D2. Further, a raised height of the secondary transfer opposing roller 13 relative to the intermediate transfer belt 10 is set as H2, and a raised height of the stretching roller 11 relative to the intermediate transfer belt 10 is set as H3. In the first embodiment, D1=60 mm, D2=50 mm, and H2=H3=2 mm.

Moreover, as shown in FIG. 2B, the three stretching rollers 11, 12, 13 supporting the intermediate transfer belt 10 in a stretched condition and the metal roller 14 are electrically connected and grounded via a 300 V Zener diode 15 serving as a constant voltage element. Note that a varistor may be used instead of the Zener diode 15.

[Configuration of Intermediate Transfer Belt]

Endless polyimide resin intermixed with carbon as a conducting agent and having a circumference of 700 mm and a thickness of 90 μm is used as a material of the intermediate transfer belt 10 according to the first embodiment. As electric characteristics, the intermediate transfer belt 10 exhibits electron conductivity and low resistance value variation relative to humidity in the atmosphere.

A fixed variation (referred to hereafter as a manufacturing error) in the resistance value of the intermediate transfer belt 10 occurs during manufacture. In the intermediate transfer belt 10 used in the first embodiment, a volume resistivity of $1\times10^9$ Ω·cm and a circumferential direction resistance value of $1\times10^7$Ω were set as central resistance values within the manufacturing error. The volume resistivity was measured using a UR type ring probe (model MCP-HTP 12) with a Hiresta-UP (MCP-HT 450), manufactured by Mitsubishi Chemical Corporation. Measurement was performed under conditions of a room temperature of 23° C., a room humidity of 50%, an applied voltage of 100 V, and a measurement time of 10 sec.

Figure 3A:
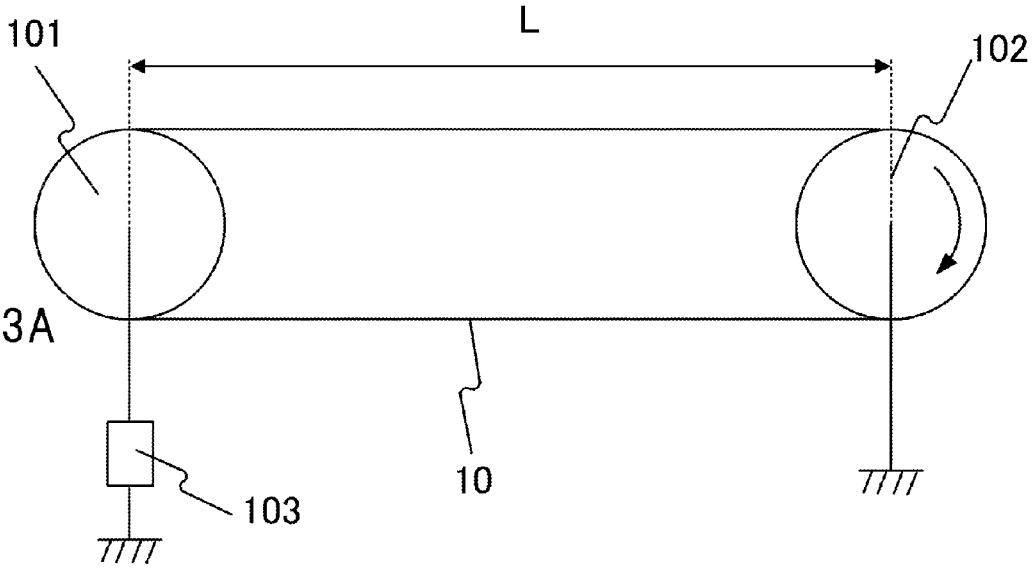
FIGS. 3A and 3B are views illustrating measurement of a resistance value of the intermediate transfer belt.
Figure 3B:
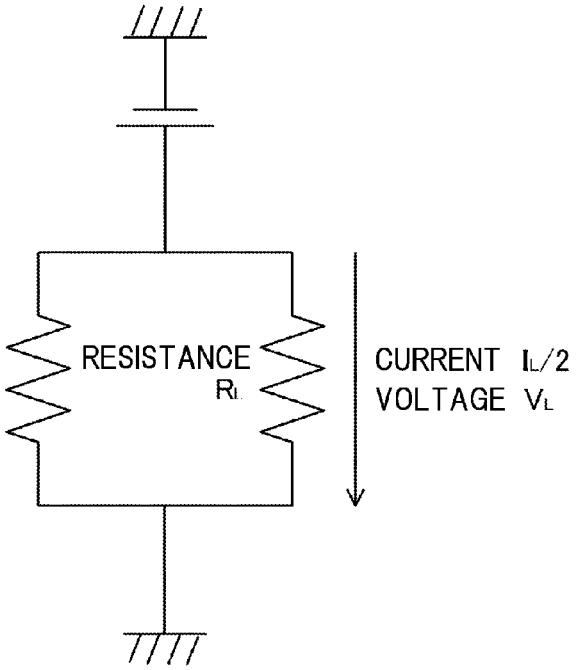

The circumferential direction resistance of the intermediate transfer belt 10 was measured using a circumferential direction resistance measurement jig shown in FIG. 3A. FIG. 3 is a view illustrating measurement of the resistance value of the intermediate transfer belt. FIG. 3A is a view showing the resistance measurement jig, and FIG. 3B is a view showing an equivalent circuit of a measurement system shown in FIG. 3A.

First, a configuration of the measurement system will be described. The intermediate transfer belt 10 to be measured is stretched around an inner surface roller 101 and a driver roller 102 so as not to sag. The metal inner surface roller 101 is connected to a high voltage power supply (a high voltage power supply manufactured by TREK Japan, Model 610E)

103, and the driver roller 102 is grounded. A surface of the driver roller 102 is covered with conductive rubber having a sufficiently lower resistance than the intermediate transfer belt 10, whereupon the driver roller 102 is rotated such that the intermediate transfer belt 10 reaches 100 mm/sec.

Next, a measurement method will be described. Ina condition where the intermediate transfer belt 10 is rotated at 100 mm/sec by the driver roller 102, a constant current IL is applied to the inner surface roller 101, whereupon a voltage VL is monitored by the high voltage power supply 103 connected to the inner surface roller 101. If the measurement system shown in FIG. 3A is considered as the equivalent circuit shown in FIG. 3B, a circumferential direction resistance RL of the intermediate transfer belt 10 over a distance L (300 mm in the first embodiment) between the inner surface roller 101 and the driver roller 102 can be calculated from RL=2 VL/IL. The circumferential direction resistance is then determined by converting the resistance RL into an intermediate transfer belt circumference corresponding to 1-00 mm of the intermediate transfer belt 10. The circumferential direction resistance of the intermediate transfer belt will be referred to hereafter as a resistance R10.

In the first embodiment, a central resistance value of the resistance R10 in the used intermediate transfer belt 10 is $1\times10^7\Omega$. Taking the manufacturing error into consideration, a range of the resistance R10 is $5\times10^6\Omega\leq R10\leq2\times10^7\Omega$. The aforesaid value was selected to ensure optimal transfer in the first embodiment. The central resistance value of the resistance R10 varies according to differences in a transfer efficiency due to differences in the belt material, and a Zener potential corresponding to the Zener diode 15.

Further, in the first embodiment, polyimide resin is used as the material of the intermediate transfer belt 10, but any other heat reversible resin may be used. For example, a material such as polyester, polycarbonate, polyarylate, acrylonitrile butadiene styrene copolymer (ABS), polyphenylene sulfide (PPS), or polyvinylidene difluoride (PVdF), or a mixed resin thereof, may be used instead.

[Primary Transfer Operation]

The primary transfer operation will now be described using the second image-forming station b. When a voltage is applied to the secondary transfer roller 20 serving as the current supply member from the secondary transfer power supply 21, a current flowing to the photosensitive drum 1*b* through the secondary transfer roller 20 and the intermediate transfer belt 10 becomes a current IA (a first current). A current flowing to the photosensitive drum 1*b* through the secondary transfer roller 20, the secondary transfer opposing roller 13, the metal roller 14, and the intermediate transfer belt 10, meanwhile, becomes a current IB (a second current).

In the configuration according to the first embodiment, a total current (a superimposed current) of the current IA and the current IB is supplied to the photosensitive drum 1*b* such that a potential (referred to hereafter as a belt potential) is formed on the surface of the intermediate transfer belt 10. An electric field traveling from the intermediate transfer belt 10 toward the photosensitive drum 1*b* is generated by a potential difference between the belt potential and a surface potential of the photosensitive drum 1*b*. Primary transfer, in which the toner on the photosensitive drum 1*b* moves onto the intermediate transfer belt 10, is performed in accordance with this electric field.

Further, the current supplied by the secondary transfer power supply 21 is controlled so as to flow to the Zener diode 15 via the secondary transfer roller 20 and the secondary transfer opposing roller 13, whereby the respective support rollers 11, 12, 13 and the metal roller 14 are maintained at the Zener potential. As a result, a current amount of the current IB corresponds to the Zener potential. In the first embodiment, the Zener potential is 300 V, and therefore, when an intermediate transfer belt 10 having a circumferential direction resistance value of $1\times10^7\Omega$ is used, a current of at least 12 μA is supplied to the second image-forming station b.

Figure 4:
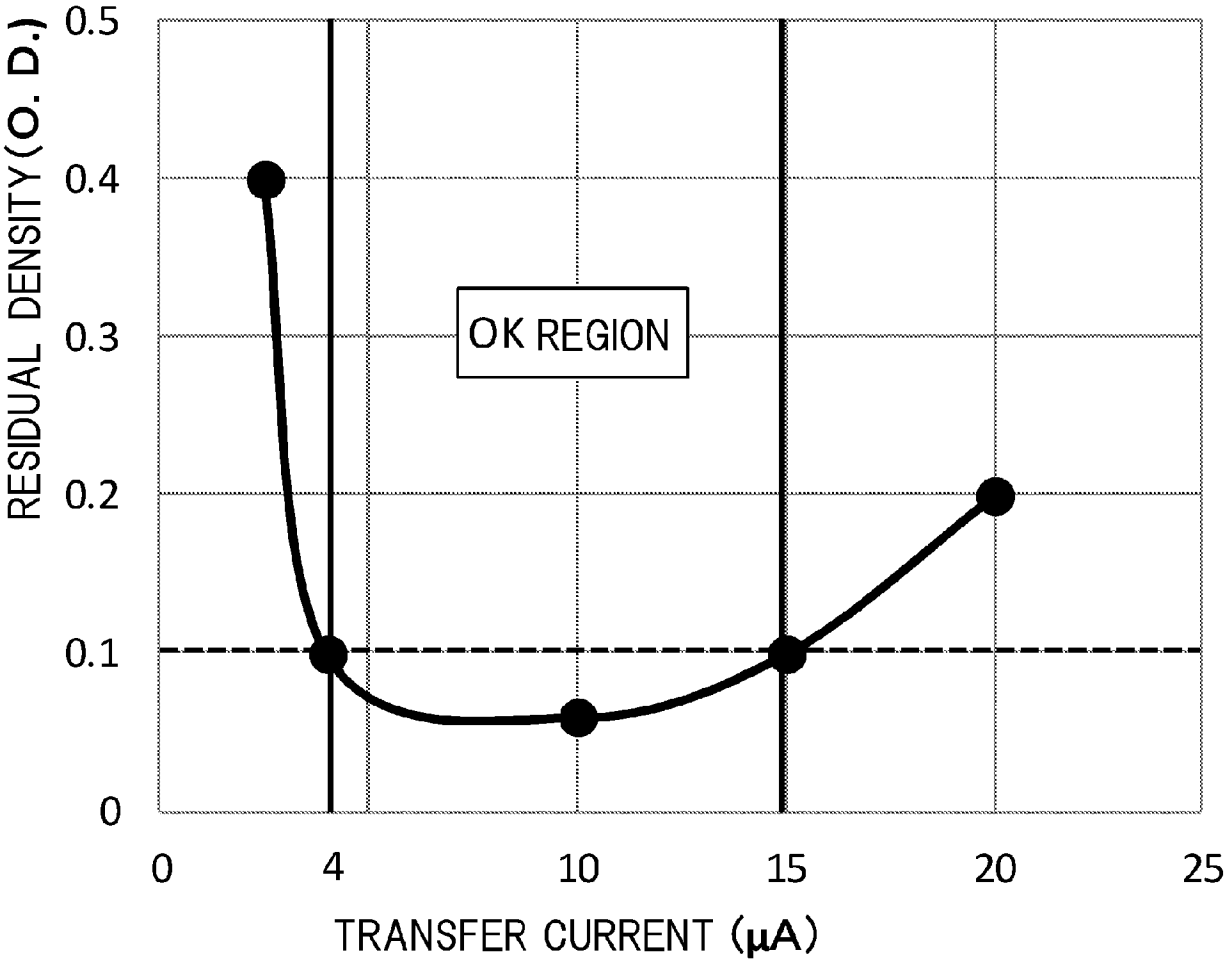
FIG. 4 is a graph showing a relationship between a primary transfer current and a residual density.

Here, FIG. 4 is a graph showing a relationship between a primary transfer current and a residual density. In FIG. 4, the abscissa shows a transfer current amount flowing to the photosensitive drum 1*b*, and the ordinate shows the residual density (O.D.: Optical density). The residual density is measured using a Macbeth densitometer (manufactured by GretagMacbeth), and a higher measurement value indicates an increased residual density, which leads to deterioration of the transfer efficiency. To secure a favorable primary transfer performance, the residual density is preferably no higher than 0.1, and it can be seen from the graph in FIG. 4 that a transfer current between 4 μA and 15 μA (an OK region shown in FIG. 4) is required.

When the transfer current is lower than 4 μA, the current value is insufficient, and therefore an appropriate potential difference cannot be formed between the photosensitive drum 1 and the intermediate transfer belt 10. As a result, the transfer efficiency deteriorates, leading to reduced density. When the transfer current is higher than 15 μA, on the other hand, an excessive current is supplied to the photosensitive drum 1, and as a result, an image defect due to drum ghost occurs.

When the resistance of the intermediate transfer belt 10 varies in this type of configuration, where primary transfer is performed using a current that flows in the circumferential direction of the intermediate transfer belt 10, an excessive current may flow into the photosensitive drum 1, and as a result, the photosensitive drum 1 may be charged unnecessarily.

Figure 8:
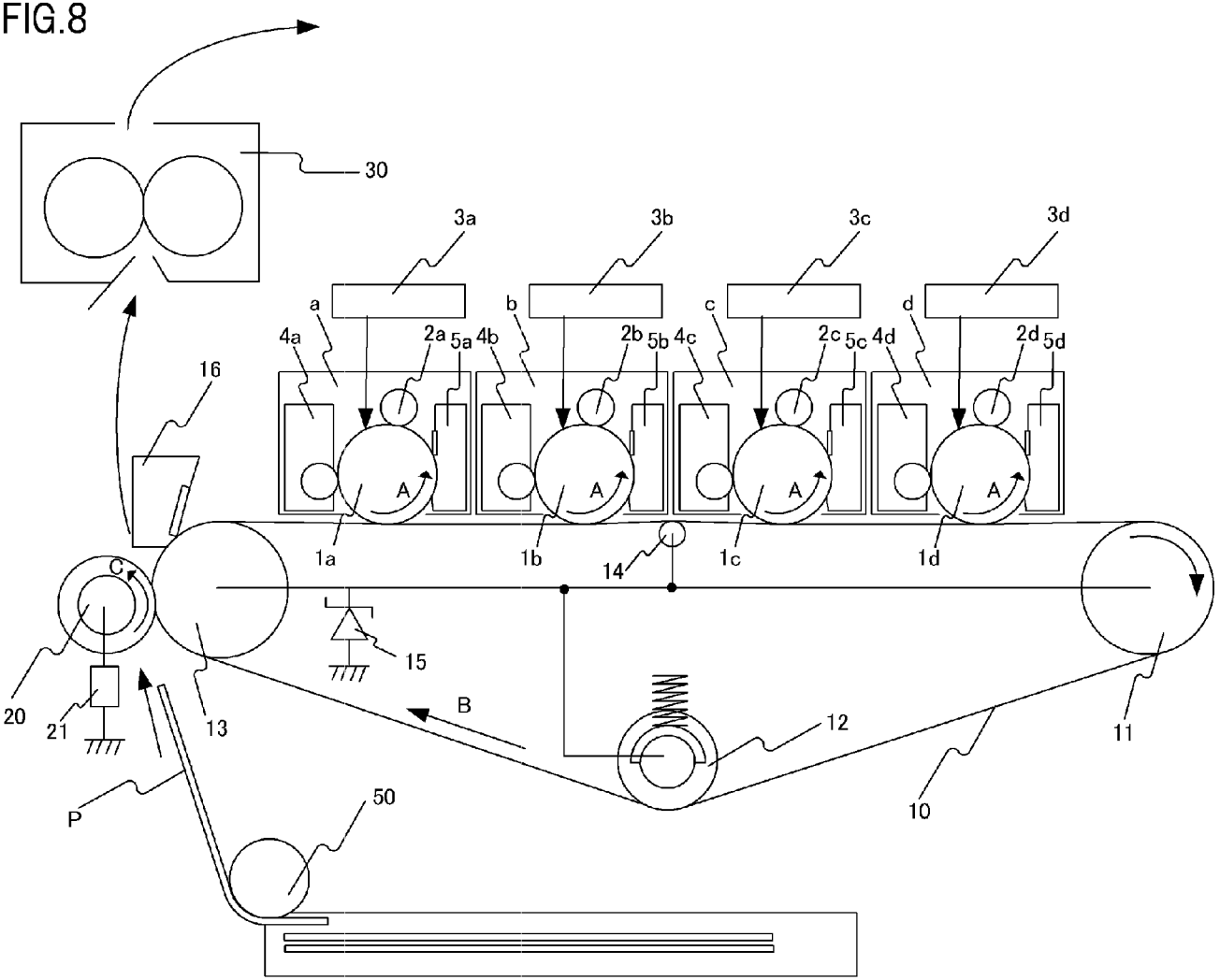
FIG. 8 is a schematic sectional view showing a configuration of an image-forming apparatus according to a comparative example.

FIG. 8 shows a configuration of a comparative example that will be used to illustrate a phenomenon whereby an excessive current flows into the photosensitive drum 1. FIG. 8 is a view illustrating an image-forming apparatus in which the metal roller 14 is directly connected to the Zener diode 15. All other configurations are identical to those of the image-forming apparatus shown in FIG. 1.

A primary transfer operation according to the configuration shown in FIG. 8 will now be described using FIG. 9. Here, the operation will be described using the second image-forming station b including the photosensitive drum 1*b*. First, a total current of the current IA flowing along a path indicated by an arrow IA in FIG. 9 and the current IB flowing along a path indicated by an arrow IB in FIG. 9 is supplied from the secondary transfer power supply 21 to the photosensitive drum 1*b*.

More specifically, the current IA flows from the secondary transfer power supply 21 to the photosensitive drum 1*b* through the secondary transfer roller 20 and the intermediate transfer belt 10. The current IB flows from the secondary transfer power supply 21 to the photosensitive drum 1*b* through the secondary transfer roller 20, the secondary transfer opposing roller 13, the metal roller 14, and the intermediate transfer belt 10.

Figure 9:
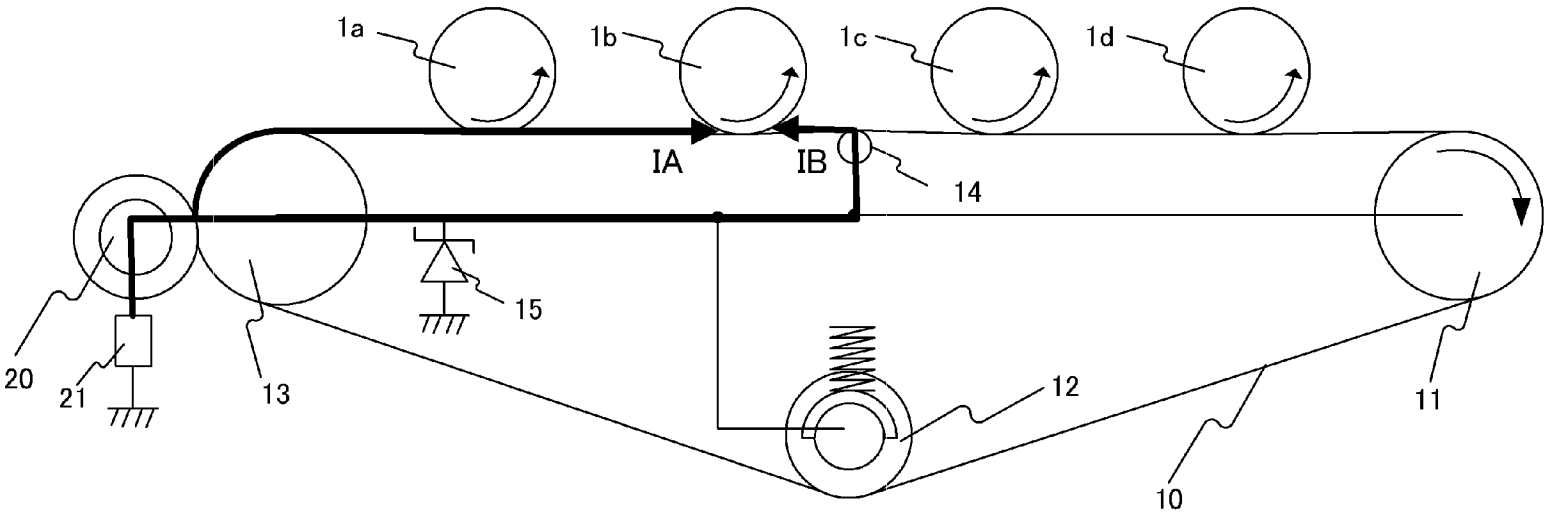
FIG. 9 is a view illustrating current supply to a photosensitive drum according to the comparative example.

In the configuration shown in FIG. 9, when the current is supplied to the photosensitive drum 1*b*, the belt potential is formed on the intermediate transfer belt 10. An electric field traveling from the intermediate transfer belt 10 toward the photosensitive drum 1*b* is generated by a potential difference between the belt potential and the potential of the photosensitive drum 1*b*. Primary transfer, in which the toner on the photosensitive drum 1*b* moves onto the intermediate transfer belt 10, is performed in accordance with this electric field.

Further, the secondary transfer power supply 21 is controlled such that a current flows to the Zener diode 15 through the secondary transfer roller 20 and the secondary transfer opposing roller 13, whereby the respective support rollers and the metal roller 14 are maintained at a voltage set in the Zener diode 15 (referred to hereafter as the Zener potential). As a result, the current amount of the current IB corresponds to the Zener potential.

Hence, the current IA that flows through the secondary transfer roller 20 and the intermediate transfer belt 10 and the current IB that flows from the metal roller 14 through the intermediate transfer belt 10 are both supplied to the photosensitive drum 1*b* as a superimposed current (a primary transfer current). As a result, an appropriate belt potential for primary transfer can be formed likewise in the downstream side image-forming stations.

With the configuration described above, however, when an impedance of the intermediate transfer belt 10 and the second image-forming station b decreases, an excessive current may flow into the photosensitive drum 1*b*, leading to shading unevenness in a printed image portion and a non-image portion following a single revolution of the photosensitive drum 1*b*. As a result, an image defect known as drum ghost may occur. Among intermediate transfer belts 10 in which resistance value variation (referred to hereafter as a manufacturing error) occurs during manufacture, drum ghost is particularly likely to occur when an intermediate transfer belt 10 having a lower limit resistance value within the manufacturing error is used.

More specifically, when the circumferential direction resistance of the intermediate transfer belt 10 decreases, the impedance of the image-forming station b decreases, and therefore the current IA and the current IB supplied to the photosensitive drum 1*b* both increase. When an excessive current flows into the photosensitive drum 1*b*, a larger amount of current flows to the non-image portion of the photosensitive drum 1*b*, in which no toner had been exist, than to the image portion in which toner had been exist. As a result, a potential difference is generated between the non-image portion and the image portion on the photosensitive drum 1*b* following primary transfer. The potential difference between the image portion and the non-image portion formed after primary transfer remains even after the photosensitive drum 1*b* is charged by the charging member 2*b*, and this potential difference causes a shading difference to occur when the toner on the photosensitive drum 1*b* is developed. As a result, the image defect known as drum ghost occurs. Drum ghost is likely to occur in an intermediate transfer belt 10 using an ion-based conductive material when the impedance of the image-forming station decreases, for example when the resistance value decreases in a high-temperature, high-humidity environment.

Featured Configuration of First Embodiment

In the first embodiment, in response to this problem, a resistance element 17 is provided between the metal roller 14 and the Zener diode 15. In this embodiment, a resistance value of the resistance element 17 is set at R17=$1\times10^7\Omega$.

Actions of First Embodiment

Actions of the first embodiment brought about by having the featured configuration described above will now be described using the second image-forming station b. As noted above, the total current (the superimposed current) of the current IA and the current IB is supplied to the photosensitive drum 1*b*. The following description centers on the current IB that flows from the metal roller 14, which is electrically connected to the secondary transfer opposing roller 13, to the photosensitive drum 1*b* in the circumferential direction of the intermediate transfer belt 10. The current IB is determined from the Zener potential (300 V in the first embodiment) of the Zener diode 15, the impedance (referred to hereafter as Rb) of the second image-forming station b, and the resistance value R17 of the resistance element 17.

More specifically, the value of IB satisfies (Rb+R17)×IB=300. In other words, IB takes a steadily larger value as the value of Rb+R17 decreases, with the result that an excessive current flows to the photosensitive drum 1*b*.

In a case where an intermediate transfer belt 10 having a low resistance value is used, since Rb is affected by the circumferential direction resistance value of the intermediate transfer belt 10, the value of Rb decreases. In the configuration according to the first embodiment, when the resistance element 17 is provided between the metal roller 14 and the Zener diode 15, an excessive current can be prevented from flowing to the photosensitive drum 1*b* even when the value of Rb is small, and as a result, drum ghost can be avoided. The resistance element 17 exhibits a similar effect in relation to the photosensitive drums 1*a*, 1*c*, 1*d*, and therefore an excessive current can be prevented from flowing to the respective photosensitive drums, with the result that drum ghost can be avoided.

Evaluation of the First Embodiment

Effects of the first embodiment will be verified below using a comparative example. To test the effects of the image-forming apparatus according to the first embodiment, the occurrence of drum ghost was checked in relation to the first embodiment and a comparative example to be described below using an image-forming apparatus having a process speed of 100 mm/sec. Note that an image formed by disposing a 30% halftone image beneath a 30 mm×30 mm solid image was used as an evaluation image, and evaluations were performed in relation to each color.

Comparative Example

In the comparative example, the resistance element 17 is not provided between the metal roller 14 and the Zener diode 15, as described above. Further, the Zener potential of the Zener diode 15 is set at 300 V, similarly to the first embodiment, and features of all other members are similar to the first embodiment.

Next, evaluation results will be described using Table 1. Table 1 shows results obtained by preparing intermediate transfer belts 10 respectively having circumferential direction resistance values R10 converted into 10 mm of $2\times10^7\Omega$, $1\times10^7\Omega$, and $5\times10^6\Omega$, and confirming the existence of drum ghost in relation to the comparative example and the first embodiment. The three prepared intermediate transfer belts 10 correspond respectively to an upper limit, a center, and a lower limit of the resistance value within the manufacturing error.

Further, since Rb is greatly affected by the circumferential direction resistance value R10 of the intermediate transfer belt 10 and the distance T from the metal roller 14 to the photosensitive drum 1*b* (the primary transfer portion N1*b*) is T=30 mm, it is assumed in the following description that Rb=R10×3.

First, results obtained in relation to the configuration of the comparative example will be described with a focus on the current IB that flows to the second image-forming station b.

When the intermediate transfer belt 10 in which R10 corresponds to the upper limit resistance value of $2\times10^7\Omega$ is used, Rb=R10×3=$6\times10^7$. Since the Zener potential of the Zener diode 15 is 300 V, Rb×IB=300, and therefore Equation 1, shown below, is obtained from these two equations.

[Math. 1]

$$IB = \frac{300}{Rb} = \frac{300}{6\times10^7} = 5\times10^{-6} \quad \text{(Equation 1)}$$

Accordingly, the current IB that flows to the photosensitive drum 1*b* becomes 5 μA. Taking into account the current IA that flows to the photosensitive drum 1*b* in the circumferential direction of the intermediate transfer belt 10, a current of at least 5 μA is supplied to the second image-forming station b, and therefore primary transfer can be performed favorably (see FIG. 4).

When the intermediate transfer belt 10 in which the resistance R10 corresponds to the central resistance value of $1\times10^7\Omega$ is used, the current IB, determined using a similar method to that described above, becomes 10 μA. Taking into account the current IA, a current of at least 10 μA is supplied to the second image-forming station b, and therefore primary transfer can be performed favorably (see FIG. 4).

When the intermediate transfer belt 10 in which the resistance R10 corresponds to the lower limit resistance value of $5\times10^6\Omega$ is used, the current IB, determined using a similar method to that described above, becomes 20 μA. Taking into account the current IA, an excessive current of at least 20 μA flows to the second image-forming station b, and therefore drum ghost occurs (see FIG. 4).

Next, the configuration of the first embodiment will be described with a focus on the current IB that flows to the second image-forming station b. In this embodiment, the resistance element 17 is provided between the metal roller 14 and the Zener diode 15, and therefore (Rb+R17)×IB=300. When the intermediate transfer belt 10 in which R10 corresponds to the upper limit resistance value of $2\times10^7\Omega$ is used, since R17 is $1\times10^7\Omega$, as described above, Rb+R17=$6\times10^7+1\times10^7=7\times10^7$, and therefore Equation 2, shown below, is obtained from these two equations.

[Math. 2]

$$IB = \frac{300}{Rb + R17} = \frac{300}{7\times10^7} \doteqdot 4.3\times10^{-6} \quad \text{(Equation 2)}$$

Accordingly, the current IB that flows to the photosensitive drum 1*b* becomes approximately 4.3 μA. Taking into account the current IA, a current of at least 4.3 μA is supplied to the second image-forming station b, and therefore primary transfer can be performed favorably (see FIG. 4).

When the intermediate transfer belt 10 in which the resistance R10 corresponds to the central resistance value of $1\times10^7\Omega$ is used, the current IB, determined using a similar method to that described above, becomes 7.5 μA. Taking into account the current IA, a current of at least 7.5 μA is supplied to the second image-forming station b, and therefore primary transfer can be performed favorably (see FIG. 4).

When the intermediate transfer belt 10 in which the resistance R10 corresponds to the lower limit resistance value of $5\times10^6\Omega$ is used, the current IB, determined using a similar method to that described above, becomes 12 μA. Taking into account the current IA, a current of at least 12 μA is supplied to the second image-forming station b, and therefore primary transfer can be performed favorably (see FIG. 4).

In other words, when the intermediate transfer belt 10 in which R10 is $5\times10^6\Omega$, i.e. the lower limit resistance value within the manufacturing error, is used, the current IB becomes 20 RA in the comparative example, and therefore an excessive current is supplied to the second image-forming station b, causing drum ghost to occur. In the first embodiment, on the other hand, the current is suppressed by the resistance element 17 such that the current IB reaches 12 RA, and therefore a favorable image can be printed by supplying an appropriate current for primary transfer to the second image-forming station b.

The resistance element 17 exhibits similar effects to those described above in relation to the image-forming stations a, c, d, and therefore excessive currents can be prevented from flowing to the respective photosensitive drums, with the result that drum ghost can be avoided. Note, however, that the distances from the metal roller 14 to the respective photosensitive drums 1*a*, 1*c*, 1*d* differ from the distance T=30 mm from the metal roller 14 to the photosensitive drum 1*b*, and therefore differences occur in the impedances of the respective image-forming stations. As a result, the current suppression effect brought about by the resistance element 17 differs slightly in each image-forming station.

TABLE 1

| CONFIGURATION | $2\times10^7\ \Omega$ (UPPER LIMIT) | $1\times10^7\ \Omega$ (CENTER) | $5\times10^6\ \Omega$ (LOWER LIMIT) |
|---|---|---|---|
| COMPARATIVE EXAMPLE | ○ | ○ | X |
| FIRST EMBODIMENT | ○ | ○ | ○ |

○: NO DRUM GHOST
X: DRUM GHOST

Figure 5:
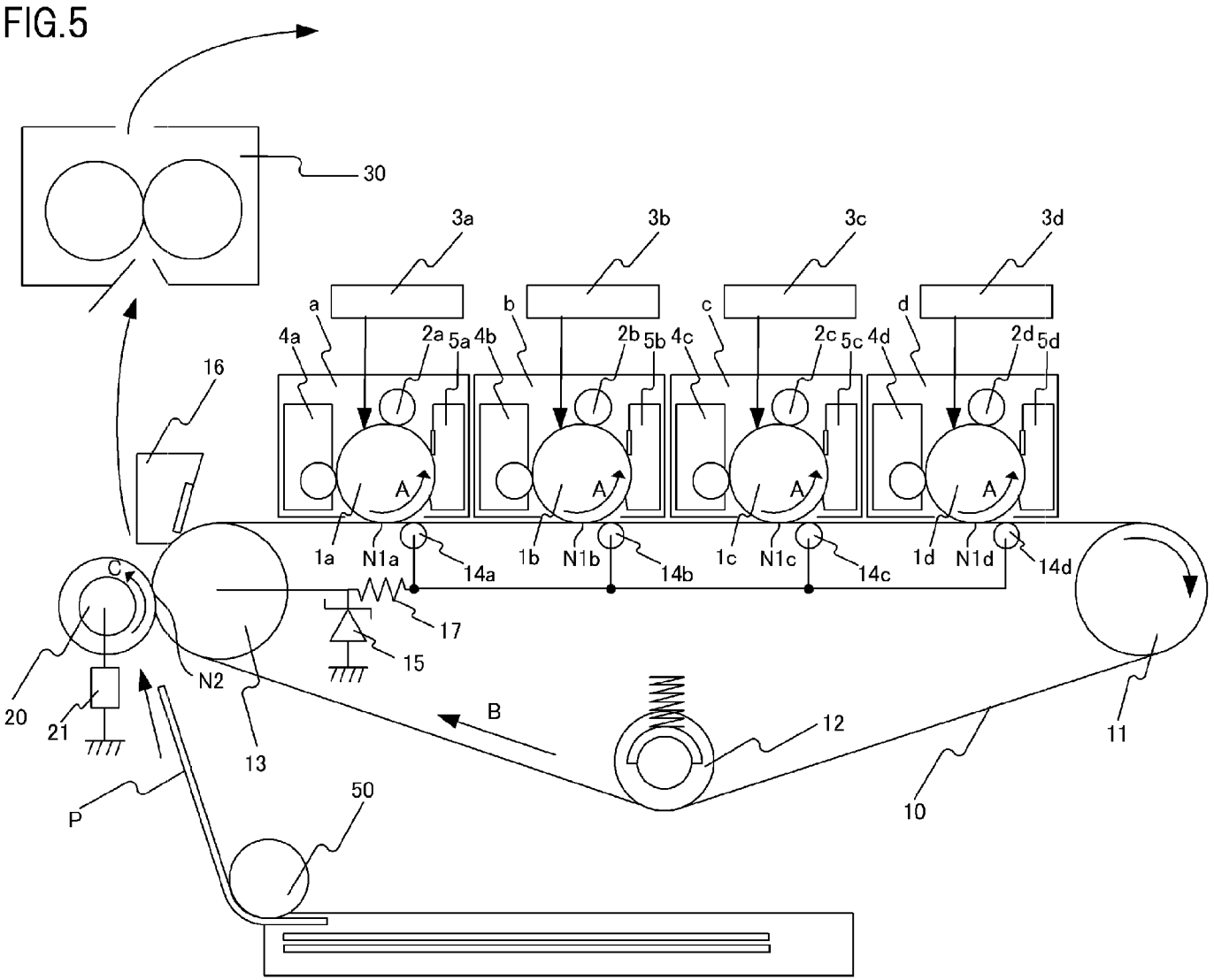
FIG. 5 is a schematic sectional view showing a configuration of an image-forming apparatus according to a modified example.

In the first embodiment, a configuration in which the single metal roller 14 is disposed between the second image-forming station b and the third image-forming station c and the resistance element 17 is provided between the metal roller 14 and the Zener diode 15 was described as a configuration for performing primary transfer. The present invention is not limited to this configuration, however, and as shown in FIG. 5, a configuration in which metal rollers 14*a*, 14*b*, 14*c*, 14*d* are disposed in positions corresponding respectively to the photosensitive drums 1*a*, 1*b*, 1*c*, 1*d* at a predetermined amount of offset thereto via the intermediate transfer belt 10 may be employed instead. Further, the secondary transfer opposing roller 13 and the metal rollers 14*a* to 14*d* may be grounded via the Zener diode 15 serving as a voltage maintaining element, and the resistance element 17 may be provided between the metal rollers 14*a* to 14*d* and the Zener diode 15.

With this configuration, the respective distances between the photosensitive drums 1*a*, 1*b*, 1*c*, 1*d* of the respective colors and the corresponding metal rollers 14*a*, 14*b*, 14*c*, 14*d* can be made equal. As a result, the impedances of the respective image-forming stations become identical such that an identical current suppression effect can be generated in the respective image-forming stations by the resistance element 17.

Further, in the first embodiment, the intermediate transfer belt 10 intermixed with carbon as a conducting agent was used, but an intermediate transfer belt 10 intermixed with an ion-conductive conducting agent may be used instead. The resistance of an intermediate transfer belt 10 intermixed with an ion-conductive conducting agent varies according to the peripheral environment. More specifically, the circumferential direction resistance decreases in a high-temperature, high-humidity environment. By providing the resistance element 17 between the metal roller 14 and the Zener diode 15, impedance variation among the image-forming stations can be suppressed, and as a result, an excessive current can be prevented from flowing. Hence, an intermediate transfer belt 10 intermixed with an ion-conductive conducting agent may be used even in a high-temperature, high-humidity environment.

Second Embodiment

Figure 6:
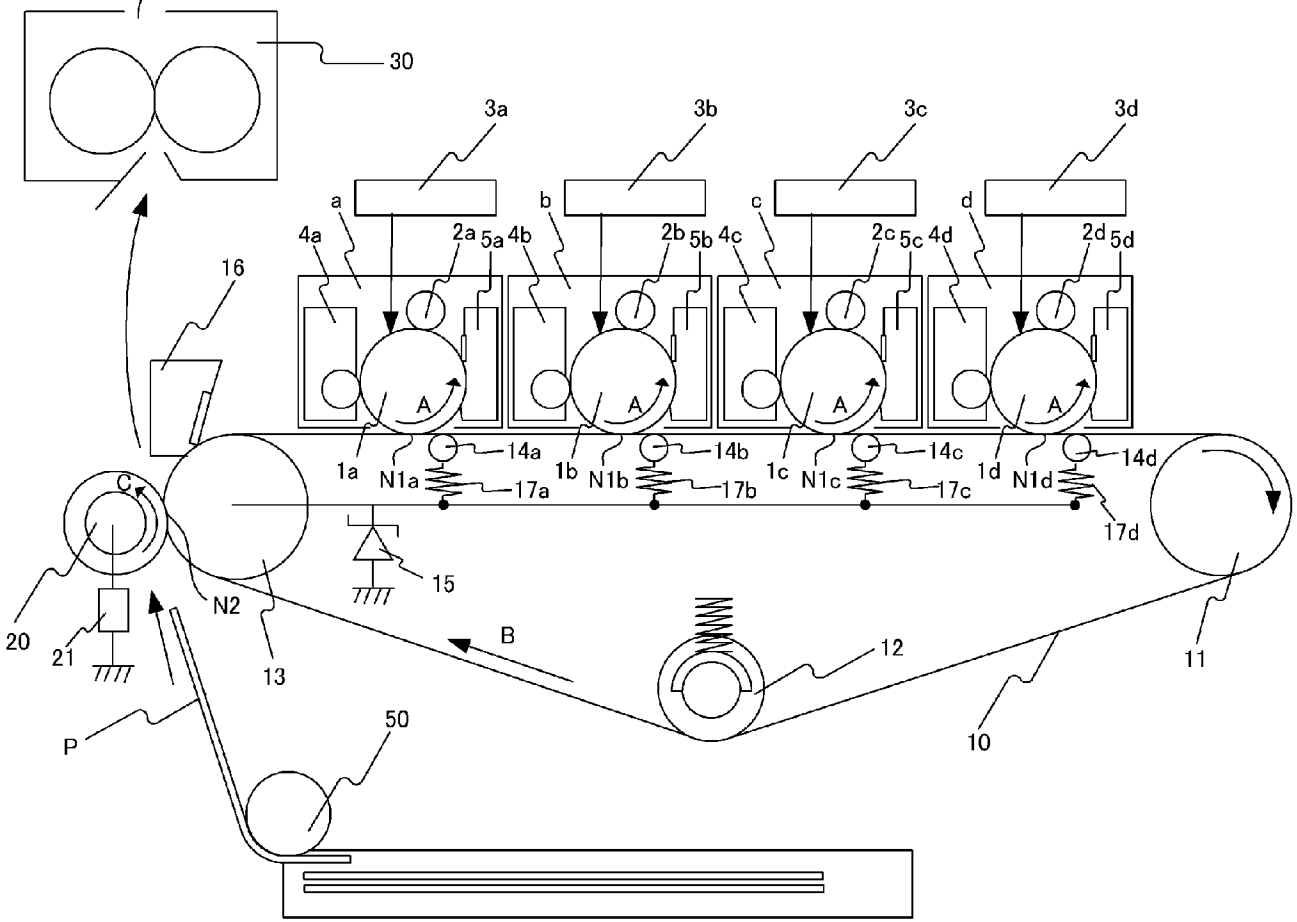
FIG. 6 is a schematic sectional view showing a configuration of an image-forming apparatus according to a second embodiment.

Next, an image-forming apparatus according to a second embodiment will be described using FIG. 6. FIG. 6 is a schematic sectional view showing a configuration of the image-forming apparatus according to the second embodiment. In the configuration of the image-forming apparatus according to the second embodiment, members that are identical to the members of the first embodiment have been allocated identical reference symbols, and description thereof has been omitted.

A featured configuration of the second embodiment will now be described. As shown in FIG. 6, in the configuration of the second embodiment, the metal roller 14 serving as a second support member is provided in a plurality. More specifically, metal rollers 14*a*, 14*b*, 14*c*, 14*d* are disposed respectively in the vicinity of the primary transfer portions N1*a*, N1*b*, N1*c*, N1*d* of the photosensitive drums 1*a*, 1*b*, 1*c*, 1*d* so as to contact the inner peripheral surface of the intermediate transfer belt 10. In other words, the metal rollers 14*a*, 14*b*, 14*c*, 14*d* are disposed in positions respectively opposing the photosensitive drums 1*a*, 1*b*, 1*c*, 1*d* at a predetermined amount of offset thereto via the intermediate transfer belt 10.

Further, the secondary transfer opposing roller 13 and the metal rollers 14*a*, 14*b*, 14*c*, 14*d* are grounded via the Zener diode 15 serving as a constant voltage element. The driver roller 11 and the tension roller 12, i.e. the other stretching rollers, are electrically insulated. Moreover, in the second embodiment, the resistance element 17 is provided in a plurality. More specifically, resistance elements 17*a*, 17*b*, 17*c*, 17*d* are provided respectively between the metal rollers 14*a*, 14*b*, 14*c*, 14*d* and the Zener diode 15. This configuration constitutes a feature of the image-forming apparatus according to the second embodiment. In the second embodiment, the resistance value of each of the resistance elements 17*a*, 17*b*, 17*c*, 17*d* is set at $1\times10^7\Omega$.

Next, actions and effects of the second embodiment will be described. In the configuration of the second embodiment, similarly to the first embodiment, an excessive current can be prevented from flowing to the image-forming stations a to d by the resistance elements 17*a* to 17*d* respectively disposed upstream of the metal rollers 14 to 14*d* in the movement direction of the intermediate transfer belt 10. Furthermore, an amount of current flowing into the image-forming stations a, b, c, d can be made even, and therefore primary transfer can be performed favorably.

This will now be described in further detail. The image-forming stations a, b, c, d differ according to use histories and printed images of the respective photosensitive drums while simultaneously being affected by the circumferential direction resistance of the intermediate transfer belt 10, and therefore differences may also occur among the impedances of the respective image-forming stations.

When the resistance elements 17*a*, 17*b*, 17*c*, 17*d* are not provided, the current amounts flowing into the image-forming stations a, b, c, d are determined by the impedances of the respective image-forming stations. Hence, a small current amount is supplied to an image-forming station having a large impedance, while a large current amount is supplied to an image-forming station having a small impedance.

As a result, differences occur among the current amounts flowing to the respective image-forming stations, and therefore primary transfer cannot be performed favorably. However, when the resistance elements 17*a* to 17*d* are provided independently upstream of the metal rollers 14*a* to 14*d*, the differences among the current amounts supplied to the respective image-forming stations can be narrowed by suppressing a current flow into an image-forming station having a small impedance. As a result, favorable primary transfer can be achieved.

Third Embodiment

Next, an image-forming apparatus according to a third embodiment will be described. An overall configuration of the image-forming apparatus according to the third embodiment is identical to that of the second embodiment, shown in FIG. 6. Accordingly, identical members have been allocated identical reference symbols, and description thereof has been omitted.

A featured configuration of the third embodiment will now be described. A feature of the image-forming apparatus according to the third embodiment is that the resistance values of the resistance elements 17 upstream of the respective metal rollers 14 disposed in positions opposing the photosensitive drums 1 differ according to the distances between the secondary transfer portion N2 and the respective primary transfer portions N1. The resistance value is set at a steadily smaller value as the distance from the secondary transfer portion N2 to the primary transfer portion N1 increases. More specifically, the resistance values of the resistance elements 17*a*, 17*b*, 17*c*, 17*d* are set at $2\times10^7\Omega$, $1\times10^7\Omega$, $6.7\times10^6\Omega$, and $5\times10^6\Omega$, respectively, in inverse proportion to the distances between the secondary transfer roller 20 serving as the current supply member and the respective image-forming stations.

Next, actions and effects of the third embodiment will be described. First, the current IA that flows from the secondary transfer power supply 21 to the photosensitive drums a, b, c, d through the secondary transfer roller 20 in the circumferential direction of the intermediate transfer belt 10 will be considered. The current amount thereof increases toward the first image-forming station near the secondary transfer roller 20, and decreases toward the fourth image-forming station far from the secondary transfer roller 20.

When the distances between the secondary transfer roller 20 and the respective image-forming stations are checked, the distance W between the photosensitive drum 1*b* of the second image-forming station b and the photosensitive drum 1*c* of the third image-forming station c is 60 mm, as shown in FIG. 2A. The distances between the photosensitive drums of the other image-forming stations are also 60 mm. Further, as shown in FIG. 2B, the distance D1 between the stretching roller 13 and the photosensitive drum 1*a* is 60 mm. Hence, the distances from the image-forming stations b, c, d to the secondary transfer roller 20 are respectively twice, three times, and four times the distance from the first image-forming station a to the secondary transfer roller 20, and therefore the current amounts flowing therein are respectively ½, ⅓, and ¼.

Next, the current IB that flows along a path extending from the secondary transfer power supply 21 to the photosensitive drums 1*a* to 1*d* through the secondary transfer roller 20 via the metal rollers 14 to 14*d* electrically connected to the secondary transfer opposing roller 13 in the circumferential direction of the intermediate transfer belt 10 will be considered. In the third embodiment, the resistance values of the resistance elements 17*a*, 17*b*, 17*c*, 17*d* are set such that the resistance upstream of the metal rollers disposed in positions opposing the photosensitive drums decreases toward the image-forming stations that are far from the secondary transfer roller 20.

More specifically, the resistance values of the resistance elements 17*b*, 17*c*, 17*d* are respectively ½, ⅓, and ¼ of the resistance value of the resistance element 17*a*. Accordingly, the amount of current flowing from the metal rollers 14*a*, 14*b*, 14*c*, 14*d* electrically connected to the secondary transfer opposing roller 13 to the photosensitive drums 1*a*, 1*b*, 1*c*, 1*d* in the circumferential direction of the intermediate transfer belt 10 decreases toward the first image-forming station that is near the secondary transfer roller 20. On the other hand, the current amount increases toward the fourth image-forming station that is far from the secondary transfer roller 20. In other words, the current amounts flowing to the image-forming stations b, c, d are respectively twice, three times, and four times the current amount flowing to the first image-forming station. As a result, the current amounts flowing to the image-forming stations a, b, c, d become even, and therefore primary transfer can be performed favorably.

Figure 7:
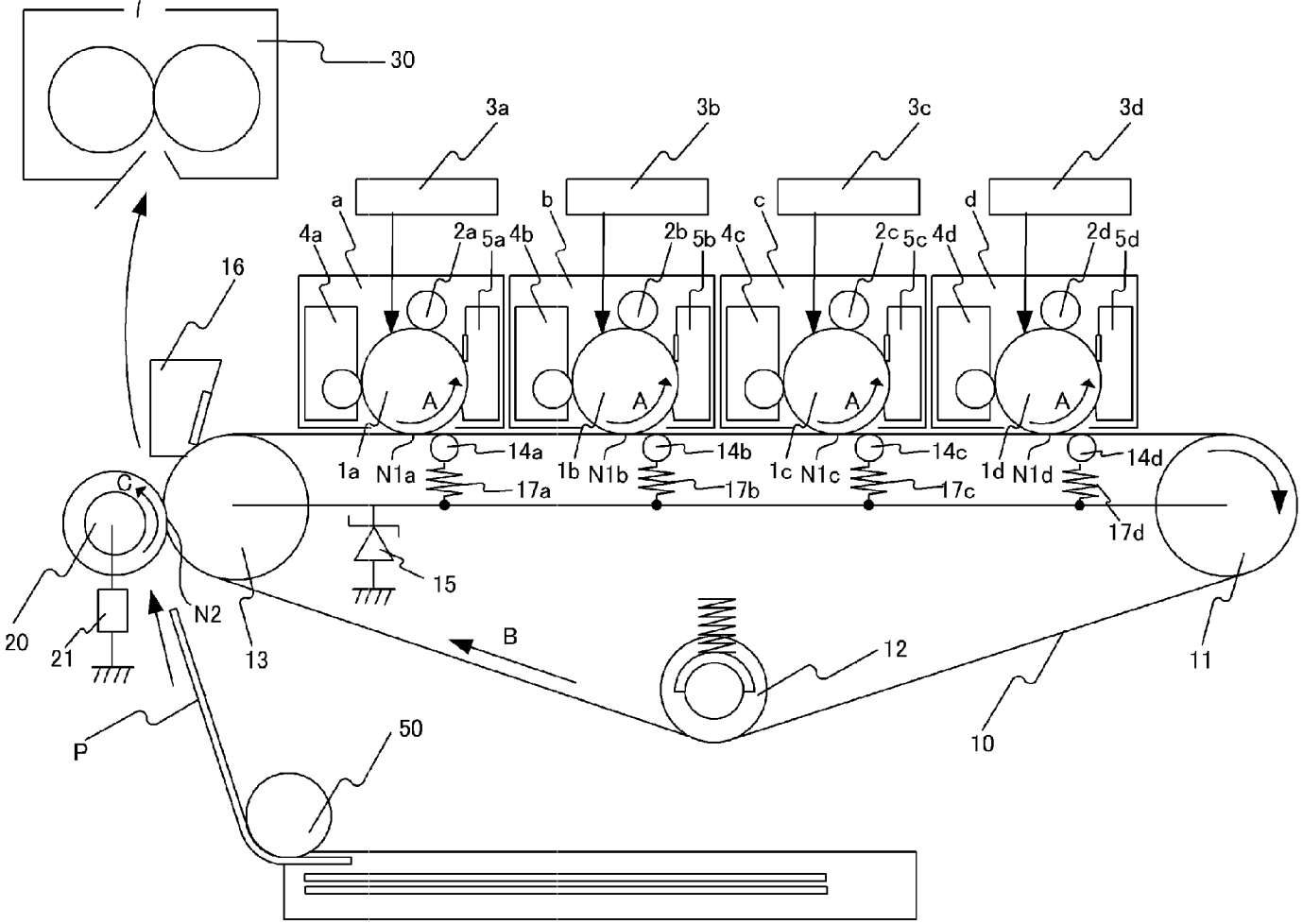
FIG. 7 is a schematic sectional view showing a configuration of an image-forming apparatus according to a third embodiment.

In the third embodiment, a configuration in which the secondary transfer opposing roller 13 and the metal rollers 14*a*, 14*b*, 14*c*, 14*d* are grounded via the Zener diode 15 was described, but the present invention is not limited thereto, and as shown in FIG. 7, for example, a configuration in which the driver roller 11, the secondary transfer opposing roller 13, and the metal rollers 14*a*, 14*b*, 14*c*, 14*d* are grounded via the Zener diode 15 may be employed instead. Note that in this configuration, the resistance values R17 of the resistance elements 17*a*, 17*b*, 17*c*, 17*d* must be set in consideration of the currents that flow into the respective image-forming stations from the driver roller 11 via the intermediate transfer belt 10.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions. This application claims the benefit of Japanese Patent Application No. 2013-133979, filed on Jun. 26, 2013, which is hereby incorporated by reference herein in its entirety.

What is claimed is:

1. An image-forming apparatus comprising:

a plurality of image bearing members for carrying toner images;

an intermediate transfer member that is capable of rotating endlessly and possesses conductivity;

a current supply member that contacts an outer peripheral surface of the intermediate transfer member;

a power supply that applies a voltage to the current supply member;

a contact member that is disposed in a position corresponding to at least one of the image bearing members via the intermediate transfer member and contacts an inner peripheral surface of the intermediate transfer member;

an opposing member that opposes the current supply member via the intermediate transfer member;

a constant voltage element connected to the opposing member and the contact member; and a resistance element electrically connected between the constant voltage element and the contact member.

2. The image-forming apparatus according to claim 1, wherein the current supply member is a secondary transfer member that performs secondary transfer of the toner images, which have undergone primary transfer onto the intermediate transfer member, onto a transfer material in a secondary transfer portion located in a contact region with the intermediate transfer member.

3. The image-forming apparatus according to claim 2, wherein the contact member is a plurality of contact members provided respectively in the vicinity of primary transfer portions, in which the respective image bearing members contact the intermediate transfer member, in a movement direction of the intermediate transfer member.

4. The image-forming apparatus according to claim 3, wherein the resistance element is electrically connected between the constant voltage element and the plurality of contact members provided respectively in the vicinity of the primary transfer portions of the respective image bearing members.

5. The image-forming apparatus according to claim 4, wherein a plurality of the resistance elements are respectively set at different resistance values.

6. The image-forming apparatus according to claim 5, wherein respective resistance values of the plurality of resistance elements decrease gradually as a distance from the secondary transfer portion to the primary transfer portion increases in the movement direction of the intermediate transfer member.

7. The image-forming apparatus according to claim 1, wherein the constant voltage element maintains the opposing member and the contact member connected thereto at a constant voltage using a current that flows via the intermediate transfer member and the opposing member when a voltage is applied to the current supply member from the power supply.

8. The image-forming apparatus according to claim 7, wherein the constant voltage element is a Zener diode.

9. The image-forming apparatus according to claim 7, wherein the constant voltage element is a varistor.

10. The image-forming apparatus according to claim 1, wherein the image bearing members are supplied with a superimposed current in which a first current that flows from the current supply member to the image bearing members through the intermediate transfer member in a circumferential direction of the intermediate transfer member when a voltage is applied to the current supply member from the power supply, and a second current that flows to the image bearing members from the current supply member through the intermediate transfer member, the constant voltage element, the contact member, and the intermediate transfer member when a voltage is applied to the current supply member from the power supply, are superimposed.

11. The image-forming apparatus according to claim 10, wherein the superimposed current generates a potential difference between a surface potential of the image bearing members and a surface potential of the intermediate transfer member such that the toner images carried on the image bearing members undergo primary transfer onto the intermediate transfer member from the image bearing members.

12. The image-forming apparatus according to claim 1, wherein the contact member is a metal roller.

13. The image-forming apparatus according to claim 1, further comprising a stretching roller that contacts the inner peripheral surface of the intermediate transfer member, wherein the intermediate transfer member is an intermediate transfer belt supported in a stretched condition by the stretching roller.

14. The image-forming apparatus according to claim 13, wherein the stretching roller is electrically insulated such that the constant voltage element is not connected thereto.

* * * * *